US008578731B2

(12) United States Patent
Jin

(10) Patent No.: US 8,578,731 B2
(45) Date of Patent: Nov. 12, 2013

(54) REFRIGERANT COMPENSATOR

(75) Inventor: Dae-Hyun Jin, Grenada, MS (US)

(73) Assignee: Advanced Distributor Products LLC, Grenada, MS (US)

( * ) Notice: Subject to any disclaimer, the term of this patent is extended or adjusted under 35 U.S.C. 154(b) by 404 days.

(21) Appl. No.: 12/984,247

(22) Filed: Jan. 4, 2011

(65) Prior Publication Data

US 2012/0167614 A1 Jul. 5, 2012

(51) Int. Cl.
*F25D 11/00* (2006.01)
*F25B 13/00* (2006.01)

(52) U.S. Cl.
USPC ..... 62/430; 62/324.4

(58) Field of Classification Search
USPC ..... 62/77, 324.4, 292, 473, 196.3
See application file for complete search history.

(56) References Cited

U.S. PATENT DOCUMENTS

| | | | | |
|---|---|---|---|---|
| 6,539,745 | B1 * | 4/2003 | Harmer et al. | 62/503 |
| 2008/0047292 | A1 * | 2/2008 | Pham et al. | 62/324.4 |
| 2008/0141698 | A1 * | 6/2008 | Hanson | 62/324.1 |
| 2008/0184727 | A1 * | 8/2008 | Innes | 62/324.4 |

OTHER PUBLICATIONS

Zhiyi et al, Defrost Improvement by heat pump refrigerant charge compensating, Apr. 15, 2008, Applied Energy, pp. 1050-1059.*

* cited by examiner

*Primary Examiner* — Brandon M Rosati
*Assistant Examiner* — Elizabeth Martin

(57) ABSTRACT

One aspect of this disclosure provides a refrigerant charge compensator having an increased heat transfer surface. The housing has an internal volume and first and second ports for allowing a passage of refrigerant therethrough. The internal volume is partitioned into an indirect refrigerant passageway that extends through the housing and a refrigerant storage area. The refrigerant storage area has a storage access port and is in contact with the indirect refrigerant passageway. Also a heat pump system implementing the compensator is provided and a method of manufacturing the compensator is provided.

5 Claims, 6 Drawing Sheets

REFRIGERANT COMPENSATOR

TECHNICAL FIELD

This application is directed, in general, to a refrigerant compensator that may be used in a heating ventilation and air conditioning system.

BACKGROUND

In heat pump systems, existing refrigerant compensators are able to adjust refrigerant charge to accommodate different amounts of refrigerant that are needed during heating and cooling cycles. Since the optimum refrigerant charge during the cooling mode is different from the refrigerant charge during the heating mode, it is necessary to adjust the refrigerant charge to get better performance at the respective operating modes for heat pump applications. Existing charge compensators comprise a tank with a vapor tube passing directly through the tank. In the cooling mode, sub-cooled liquid refrigerant further cools down and is stored in the compensator due to heat transfer because the temperature of the refrigerant vapor passing through the compensator is lower than the sub-cooled liquid refrigerant. Conversely, in the heating mode, stored refrigerant is driven from the compensator because the stored refrigerant absorbs heat from the higher temperature vapor passing through the compensator.

SUMMARY

One aspect of this disclosure provides a refrigerant charge compensator having an increased heat transfer surface. This embodiment comprises a housing having an internal volume and first and second ports for allowing a passage of refrigerant therethrough. The internal volume is partitioned into an indirect refrigerant passageway that extends through the housing and a refrigerant storage area. The refrigerant storage area has a storage access port and is in contact with the indirect refrigerant passageway.

In another aspect a heat pump system is disclosed. This embodiment comprises a compressor, an inside heat exchanger in fluid connection with the compressor by a first refrigerant line, an outside heat exchanger in fluid connection with the compressor by a second refrigerant line, and a compensator in fluid connection with the first refrigerant line and interposed the inside heat exchanger and the compressor. In this embodiment, the compensator comprises a housing having an internal volume and first and second ports for allowing a passage of refrigerant therethrough. The internal volume is partitioned into an indirect refrigerant passageway that extends through the housing and a refrigerant storage area. The refrigerant storage area has a storage access port and is in contact with the indirect refrigerant passageway. The heat pump system further comprises a third refrigerant flow line fluidly connecting the inside heat exchanger and the outside heat exchanger. The third refrigerant line has first and second bypass valves and thermal expansion valves connected thereto and interposed the inside heat exchanger and said outside heat exchanger. The refrigerant storage area is in fluid connection with the third refrigerant flow line through the storage access port.

In another embodiment, a method of manufacturing a compensator for a heat pump unit is provided. This embodiment comprises forming a housing having an internal volume, forming first and second ports in the housing for allowing a passage of refrigerant therethrough, partitioning the internal volume into an indirect refrigerant passageway that extends through said housing, and a refrigerant storage area that is in contact with the indirect refrigerant passageway, and forming a storage access port in the housing to access the refrigerant storage area.

BRIEF DESCRIPTION

Reference is now made to the following descriptions taken in conjunction with the accompanying drawings, in which.

DETAILED DESCRIPTION

Figure 1:
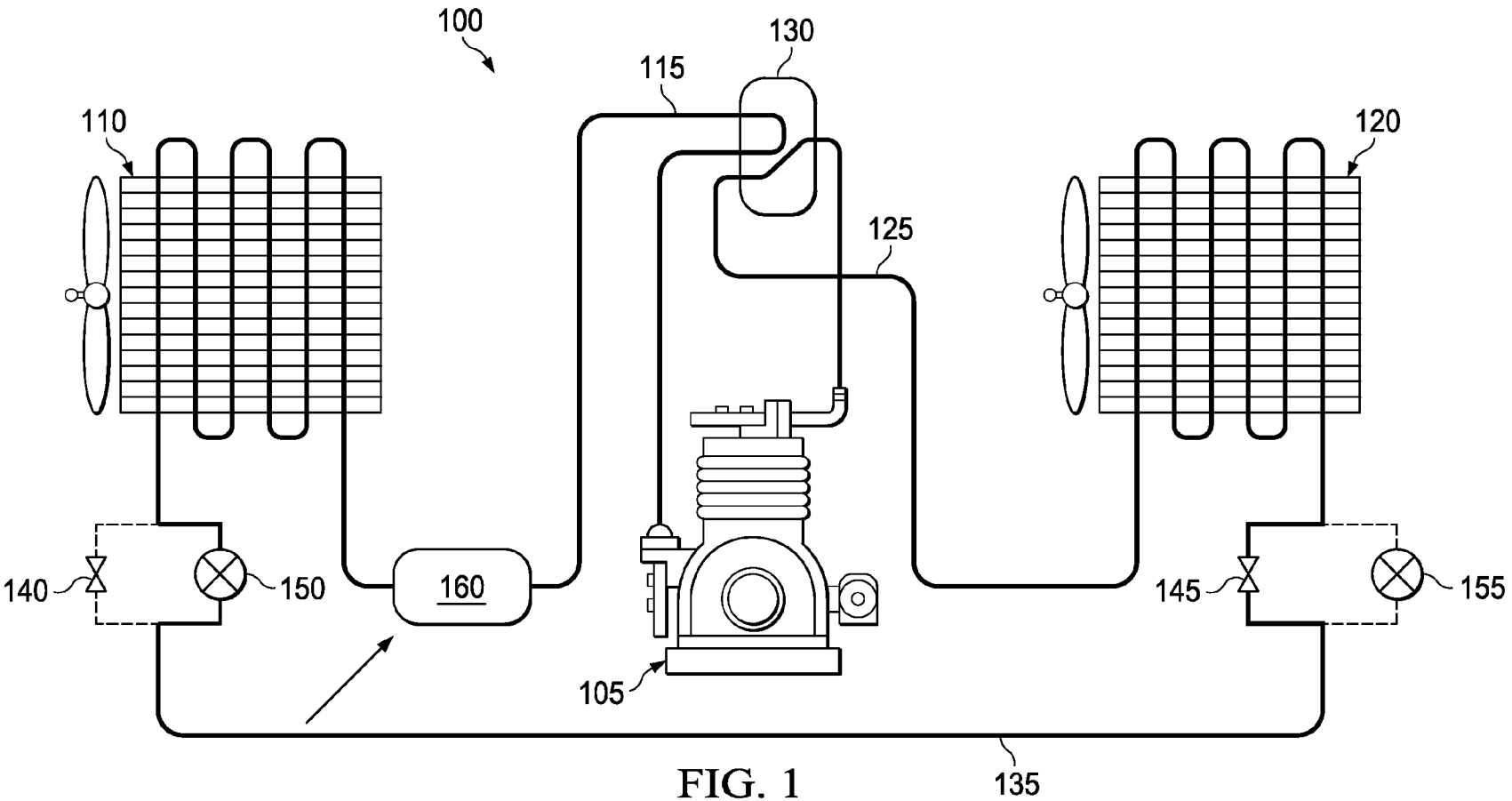
FIG. 1 illustrates a heat pump system implementing the compensator as disclosed herein.

FIG. 1 illustrates an embodiment of a heat pump system 100 in which various embodiments of the compensator, as described herein, may be employed. In the embodiment illustrated in FIG. 1, the heat pump system 100 comprises a compressor unit 105 that is fluidly connected to an inside heat exchanger 110 by a first refrigerant line 115 and is fluidly connected to an outside heat exchanger 120 by a second refrigerant line 125. As used throughout this disclosure and in the claims, fluidly connected means that system is capable of transmitting a refrigerant fluid from one component to another. The term does not necessitate the presence of the fluid or vapor, neither does it exclude it. A reversing valve 130 allows the direction of the refrigerant flow to be reversed, depending on which cycle is being implemented. The inside and outside heat exchangers 110, 120 are fluidly connected by a third refrigerant line 135 and include a pair of bypass valves 140, 145 and thermal expansion valves, 150, 155 located between the inside and outside heat exchangers 110, 120. The above discussed components may all be of conventional design.

The heat pump system 100 further includes an improved compensator 160, embodiments of which are described below. The compensator 160 is interposed the compressor unit 105 and the inside heat exchanger 100 and is fluidly connected to the first refrigerant line 115 and to the third refrigerant line 135. Details of the way in which the compensator 160 is connected to the first and third refrigerant lines 115, 135 are described below.

Figure 2A:
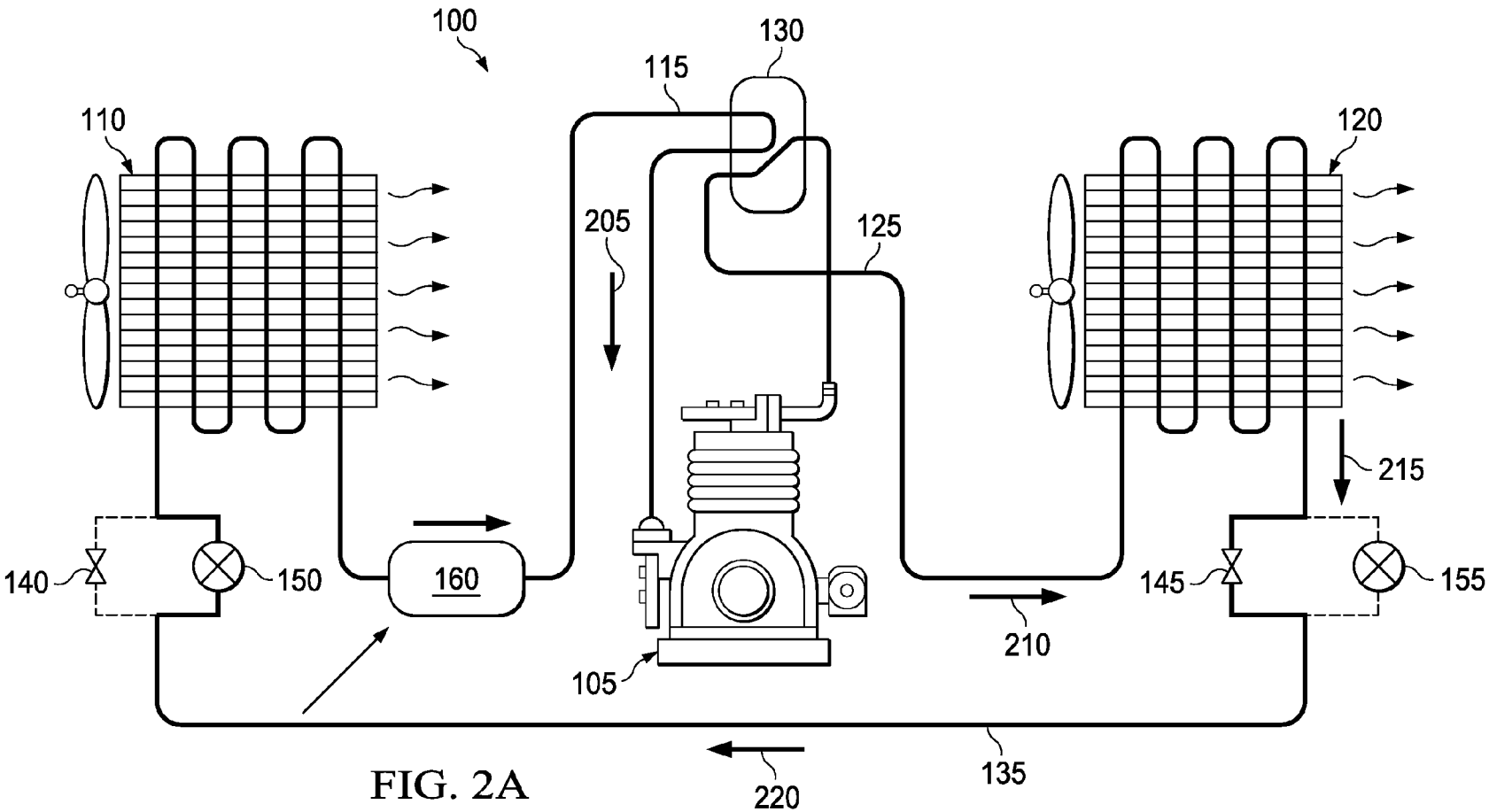
FIG. 2A-2B illustrate the heat pump system of FIG. 1 in a cooling mode and heat mode, respectively.
Figure 2B:
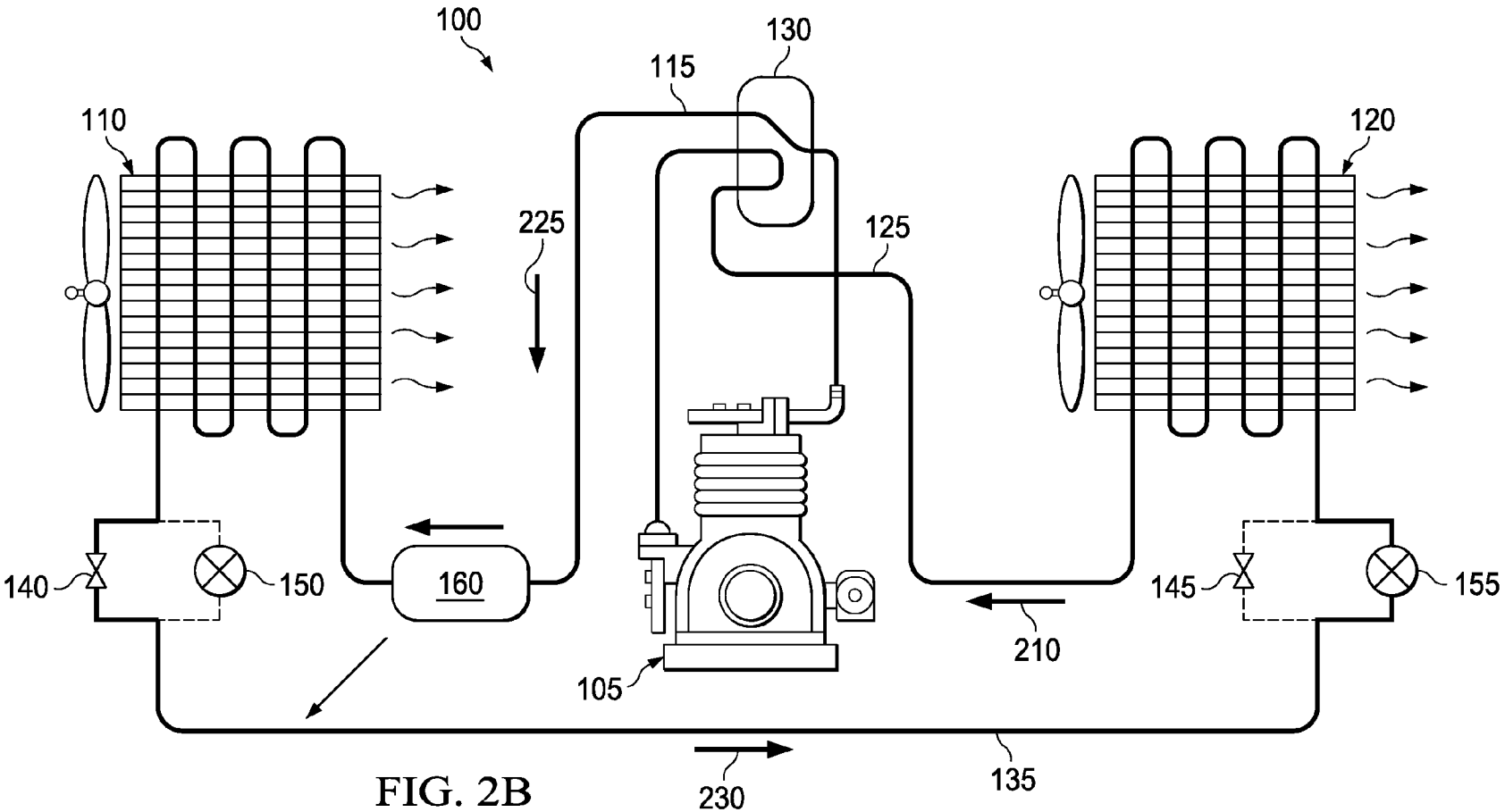

FIGS. 2A and 2B illustrate the heat pump system 100 in a cooling mode and a heating mode, respectively. During the cooling mode, which is shown in FIG. 2A, refrigerant vapor 205 enters the compressor 105 where it is compressed and exits the compressor 105 as a superheated vapor 210. The superheated vapor 210 travels through the refrigerant line 125 to the outside heat exchanger 120. The superheated vapor 210 then traverses the outside heat exchanger 120, which first cools and removes the superheat, and then condenses the vapor into a sub-cooled liquid refrigerant 215 by removing additional heat at substantially constant pressure and temperature. The sub-cooled liquid refrigerant 215 goes through the bypass valve 145 and the sub-cooled liquid 220 travels through refrigerant line 135 where a portion of the sub-cooled liquid 220 is drawn into a storage area located within the compensator 160 through a storage access port. The remaining sub-cooled liquid 220 then proceeds through the thermal expansion valve 150 where its pressure abruptly decreases and the refrigerant vapor quality at the inlet of the inside heat exchanger 110 is about 20% and to the inside heat exchange 110 where it is completely vaporized by cooling the warm air (from the space being refrigerated) being blown by a fan across the inside heat exchanger 110. The resulting superheated refrigerant vapor then travels through the refrigerant passageway in the compensator 160 and the refrigerant line 115 and to the compressor 105 to complete the thermodynamic cycle.

Due to the temperature difference (which can vary as much as 30° F. to 70° F.) between the sub-cooled refrigerant liquid in the storage area and the refrigerant vapor passing through the refrigerant passageway within the compensator 160, the sub-cooled liquid is cooled further, which allows additional refrigerant liquid to be stored within the storage area of the compensator 105.

In conventional designs, the refrigerant passageway goes directly through the compensator, which limits the surface area for heat transfer purposes. However, as described below, embodiments of the compensator 160 of the present disclosure provide the improved heat transfer surface area by providing an indirect refrigerant flow path through the compensator 160 and increases the efficiency of the compensator's operation.

FIG. 2B illustrates the heat pump 100 in a heating mode. During the heating mode, the reversing valve 130 is engaged, which reverses the above described process. In this mode, refrigerant vapor enters the compressor 105 where it is compressed and exits the compressor 105 as a superheated vapor 225. The superheated vapor 225 travels through the refrigerant line 115 and through the compensator 160 by way of the refrigerant passageway within the compensator 160. At this point the superheated vapor 225 transfers heat through the increased surface area of the refrigerant passageway within the compensator 160 and heats the sub-cooled liquid stored in the storage area of the compensator 160, which causes it to be driven out by way of the storage access port and into refrigerant line 135. The superheated vapor travels 225 on to the inside heat exchanger 110, which first cools and removes the superheat and then condenses the vapor into a sub-cooled liquid by removing additional heat at substantially constant pressure and temperature. The removed heat is transferred from the inside heat exchanger 110 into the space intended to be heated by a fan. The sub-cooled liquid refrigerant goes through the bypass valve 140, and the sub-cooled liquid 230 travels through refrigerant line 135 where a portion of the vaporized sub-cooled liquid is drawn back into the refrigerant line 135 from the storage area located within the compensator 160, thereby increasing the amount of refrigerant vapor in the refrigerant line 135. The sub-cooled liquid vapor mixture then proceeds through the thermal expansion valve 155 where its pressure abruptly decreases and the refrigerant vapor quality at the inlet of the outside heat exchanger 110 is about 20% and to the outside heat exchange 120 where it is further vaporized. The resulting refrigerant vapor then travels through the refrigerant passageway 125 and to the compressor 105 to complete the thermodynamic cycle.

The driving force of the refrigerant change adjustment is based on heat transfer between the vapor refrigerant passing through the compensator 160 and the sub-cooled liquid refrigerant stored in the storage area of the compensator 160. Because the compensator, as disclosed herein, provides additional surface area for heat transfer within the compensator, more refrigerant liquid can be stored in the compensator 160. This improvement makes more refrigerant vapor available during for the heating mode, which in turn, increases the efficiency of the operation of heat pump system 100.

Figure 3:
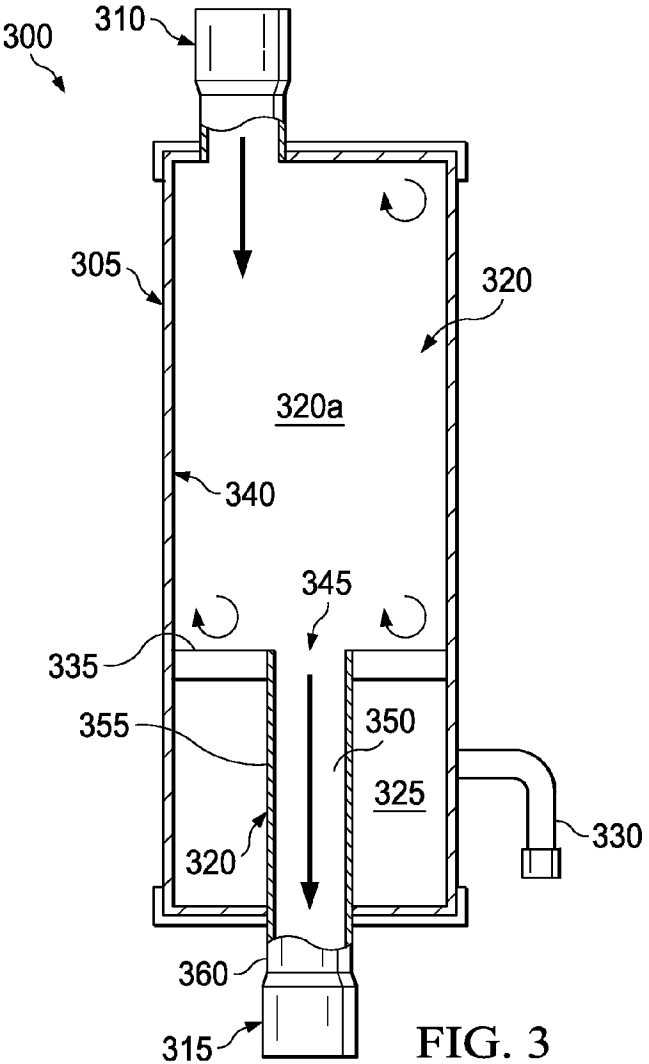
FIG. 3 illustrates a sectional view of one embodiment of the compensator as provided herein.

FIG. 3 illustrates a sectional view of one embodiment of the compensator 160 of FIG. 1. In this particular embodiment, compensator 300 includes a housing 305, which is appropriately constructed of a material, such as metal, that is able to withstand the operating pressures of a heat pump system. The housing 305 is hollow and has an internal volume and further includes first and second ports 310, 315 for allowing a passage of refrigerant through the housing 305. As seen in this embodiment, one or both of the ports may be off-centered with respect to the housing 305, which provides the advantage of preventing compressor lubricant from being stored in the housing 305. The first and second ports 310, 315 may either be exit ports or entry ports, depending on the operational mode of the heat pump system to which the compensator 300 is connected. The ports 310, 315 may have different configurations, depending on the embodiment. For example, the ports 310, 315 may be a separate connection nipple that may be welded to an opening in the housing 305, or it may be the opening itself, or alternatively, it may be an extension of a refrigerant passageway that extends outwardly from the housing 305.

The internal volume is partitioned into an indirect refrigerant passageway 320 that extends through the housing 305 and a refrigerant storage area 325. The refrigerant storage area 325 has a storage access port 330 by which the storage area 325 can be connected to refrigerant line 135 in a manner discussed above regarding FIG. 1. The storage access area 325 is also in contact with the indirect refrigerant passageway 320, which allows for heat transfer between the refrigerant storage area 325 and the indirect refrigerant passageway 320. In this particular embodiment, the partitioning is accomplished by a wall 335 that is attached to an interior surface 340 of the housing 305. Typically, the wall 335 will be brazed or welded to the interior surface 340 to form a pressure seal between them. The wall 335 has an opening 345 that allows for the passage of the refrigerant. This particular embodiment further comprises a refrigerant tube 350 that is located within the housing 305. The refrigerant tube 350 has first and second ends 355 360, wherein the first end 355 is attached to the wall 335 at the opening 345 to form a refrigerant passageway through the wall 335, and the second end 360 is fluidly connected to the second port 315. Of course it should be understood that the design could be reversed such that the second end 335 is fluidly connect to the first port 310. Thus, in this embodiment, the refrigerant passageway 320 comprises an indirect refrigerant passageway chamber **320*a* that is formed by the partitioned space 320, and further comprises the refrigerant tube 350. The volume of the indirect refrigerant passageway chamber 320*a* is defined by wall 335 and a portion of the housing 305**, as illustrated. This configuration may provide at least about a 27% increase in heat transfer surface area over conventional designs, which allows for improved heat transfer, and thereby, more efficient operation of the heat pump system.

As used in this disclosure and the claims, the word indirect means that a refrigerant, when passed through the compensator, would not take a direct route through the refrigerant passageway in that the refrigerant either encounters one or more walls or surfaces within the housing that are not parallel with the direction of the flow of the refrigerant through the housing. These areas are generally designated in the figures by circular arrows. In other examples, the refrigerant passageway 320 may include a serpentine configuration, such as a corrugated or spiral section. The purpose of the indirect passageway 320 is to provide additional surface area for heat transfer that does not currently exist in conventional compensators. For example, in conventional compensators the refrigerant passageway typically consists of a straight tube that has the same diameter within the housing as it does outside the housing. As a result, the heat transfer surface area is limited to whatever geometry the tube has going into the housing.

Figure 4:
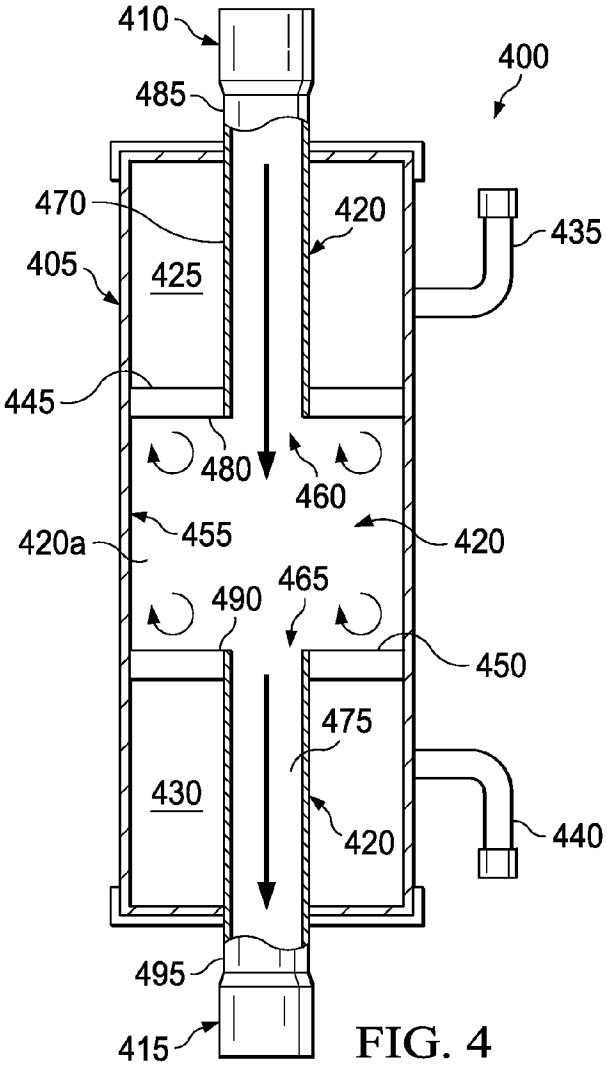
FIG. 4 illustrates a sectional view of another embodiment of the compensator as provided herein.

FIG. 4 illustrates a sectional view of another embodiment of the compensator 160 of FIG. 1. In this embodiment, the compensator 400 comprises a housing 405, which is appropriately constructed of a material, such as metal, that can withstand the operating pressures of a heat pump system. The housing 405 is hollow and has an internal volume and further includes first and second ports 410, 415 for allowing a passage of refrigerant through the housing 405. The first and second ports 410, 415 may either be exit ports or entry ports, depending on the operational mode of the heat pump system to which the compensator 400 is connected. The ports 410, 415 may also have different configurations, depending on the embodiment. For example, the ports 410, 415 may be a separate connection nipple that is brazed to an opening in the housing 405, or it may be the opening itself, or alternatively, it may be an extension of a refrigerant passageway that extends outwardly from the housing 405, as shown in FIG. 4.

In the embodiment of FIG. 4, the internal volume is partitioned into an indirect refrigerant passageway 420 that extends through the housing 405, and refrigerant storage areas 425 and 430. Both of the refrigerant storage areas 425, 430 are in contact with different areas of the indirect refrigerant passageway 420, as illustrated. Additionally, each of the refrigerant storage areas 425, 430 has a storage access port 435, 440, respectively, which allows the compensator 400 to be connected to the refrigerant line 135 in a manner discussed above regarding FIG. 1.

In this particular embodiment, the partitioning is accomplished with two spaced apart walls 445 and 450 that are attached to an interior surface 455 of the housing 405. Typically, the walls 445 and 450 will be brazed or welded to the interior surface 455 to form a seal between them. Each of the walls 445, 450 have openings 460, 465, respectively, that allow for passage of the refrigerant. This particular embodiment further comprises refrigerant tubes 470, 475 that are located within the housing 405. The refrigerant tube 470 has first and second ends, 480, 485, wherein the first end 480 is attached, typically by welding, to the wall 445 at the opening 450, and the second end 485 is located outside the housing 405 at the port 410.

Similarly, the refrigerant tube 475 has first and second ends 490, 495, wherein the first end 490 is attached, typically by a welding, to the wall 450 at the opening 465 that forms a refrigerant passageway through the wall 450, and the second end 495 is located outside the housing 405 at the port 415.

Thus, in this embodiment, the indirect refrigerant passageway 420 comprises refrigerant tubes 470, 475 that extend through the storage areas 425, 430 to the outside of the housing 405 and an indirect refrigerant passageway chamber 420*a* located between the two storage areas 425, 430. The volume of the indirect refrigerant passageway chamber 420*a* is defined by the walls 445, 450 and a portion of the housing 405, as illustrated. This configuration may provide at least about a 67% increase in heat transfer surface area over conventional designs, which allows for improved heat transfer, and thereby, more efficient operation of the heat pump system.

Figure 5:
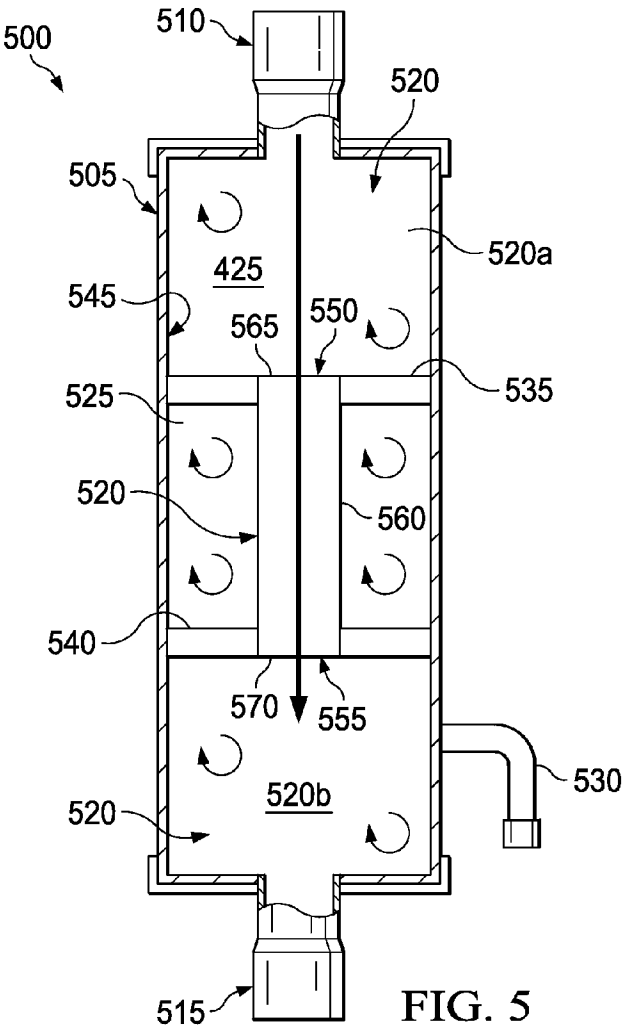
FIG. 5 illustrates a sectional view of another embodiment of the compensator as provided herein.

FIG. 5 illustrates a sectional view of another embodiment of the compensator 160. In this embodiment, compensator 500 comprises a housing 505, which is appropriately constructed of a material, such as metal, that can withstand the operating pressures of a heat pump system. The housing 505 is hollow and has an internal volume and further includes first and second ports 510, 515 for allowing a passage of refrigerant through the housing 505. The first and second ports 510, 515 may either be exit ports or entry ports, depending on the operational mode of the heat pump system to which the compensator 500 is connected. The ports 510, 515 may also have different configurations, depending on the embodiment. For example, in the illustrated embodiment, the ports 510, 515 are separate connection nipples that are welded to an opening in the housing 505, as shown in FIG. 5.

In the embodiment of FIG. 5, the internal volume is partitioned into an indirect refrigerant passageway 520 that extends through the housing 505, and a refrigerant storage area 525 that is in contact with the refrigerant passageway 520, as illustrated. Additionally, the refrigerant storage area 525 has a storage access port 530, which allows the compensator 500 to be connected to the refrigerant line 135 in a manner discussed above regarding FIG. 1.

In this particular embodiment, the partitioning is accomplished by two spaced apart walls 535 and 540 that are attached to an interior surface 545 of the housing 505. The walls 535, 540 form the storage area 525 between them and also form indirect refrigerant passageway chambers 520*a* and 520*b* on opposing ends of the housing 505. The volume of each chamber 520*a* and 520*b* is defined by the walls 535 and 540, respectively, and portions of the housing 505, as illustrated. Typically, the walls 535 and 540 will be welded to the interior surface 545 to form a seal between them. Each of the walls 535, 540 have openings 550, 555, respectively, that allow for the passage of the refrigerant. The indirect refrigerant passageway 520 further comprises a refrigerant tube 560 that is located within the housing 505 and between the walls 535, 540. The refrigerant tube 560 has first and second ends, 565, 570, wherein the first end 565 is attached, typically by welding, to the wall 535 at the opening 550 that forms a refrigerant passageway through the wall 535, and the second end 570 is attached to the wall 540 at the opening 555 that form a refrigerant passageway through the wall 540. The chambers 520*a* and 520*b* are fluidly connected to the ports 510, 515, respectively, as shown in FIG. 5.

Thus, in this embodiment, the indirect refrigerant passageway 520 comprises indirect refrigerant passageway chambers 520*a*, 520*b* located on opposing ends of the housing 505, and the refrigerant tube 560 that extends between the two chambers 520*a*, 520*b*. The storage area 525 is located between and in contact with both chambers 520*a*, 520*b* such that heat transfer can occur. This configuration may provide at least about a 67% increase in heat transfer surface area over conventional designs, which allows for improved heat transfer, and thereby, more efficient operation of the heat pump system.

Figure 6:
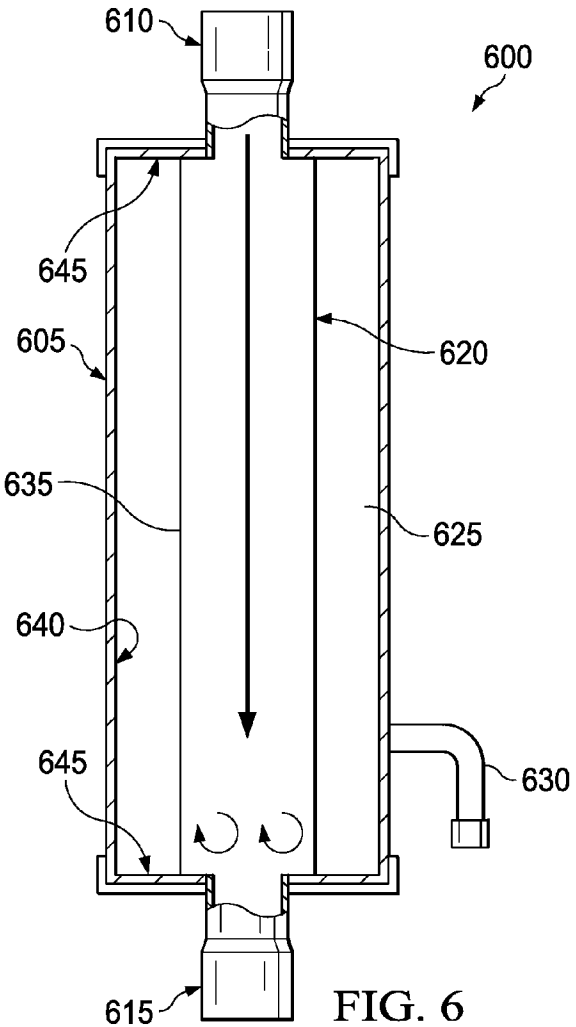
FIG. 6 illustrates a sectional view of another embodiment of the compensator as provided herein.

FIG. 6 illustrates a sectional view of another embodiment of the compensator 160. In this embodiment, the compensator 600 comprises a housing 605, which is appropriately constructed of a material, such as metal, that can withstand the operating pressures of a heat pump system. The housing 605 is hollow and as an internal volume and further includes first and second ports 610, 615 for allowing a passage of refrigerant through the housing 605. The first and second ports 610, 615 may either be exit ports or entry ports, depending on the operational mode of the heat pump system to which the compensator 600 is connected. The ports 610, 615 may also have different configurations, depending on the embodiment. For example, in the illustrated embodiment, the ports 610, 615 are separate connection nipples that are welded to an opening in the housing 605, as shown in FIG. 6.

In the embodiment of FIG. 6, the internal volume is partitioned into an indirect refrigerant passageway 620 that extends through the housing 605, and a refrigerant storage area 625 that is in contact with the refrigerant passageway 620, as illustrated. Additionally, the refrigerant storage area 625 has a storage access port 630, which allows the compensator 600 to be connected to the refrigerant line 135 in a manner discussed above regarding FIG. 1.

In this particular embodiment, the partitioning is accomplished by attaching a wall 635 having larger diameter to interior surfaces 645 of the housing 605 that essentially forms a cylindrical shape, but one that has a larger diameter than the either of the ports 610, 615. The wall 635 forms the storage area 625 about the perimeter of the wall 635 and the interior surface 640 of the housing 605. Typically, the wall 635 will be welded to the interior surfaces 645 to form a seal between them. Though this particular embodiment presents a relatively straight refrigerant passageway, it is still an indirect refrigerant passageway because the larger diameter of the indirect refrigerant passageway 620 presents walls within the indirect refrigerant passageway 620 that result from the increased diameter of the passageway, which increases the heat transfer area of the compensator 600.

Figure 7:
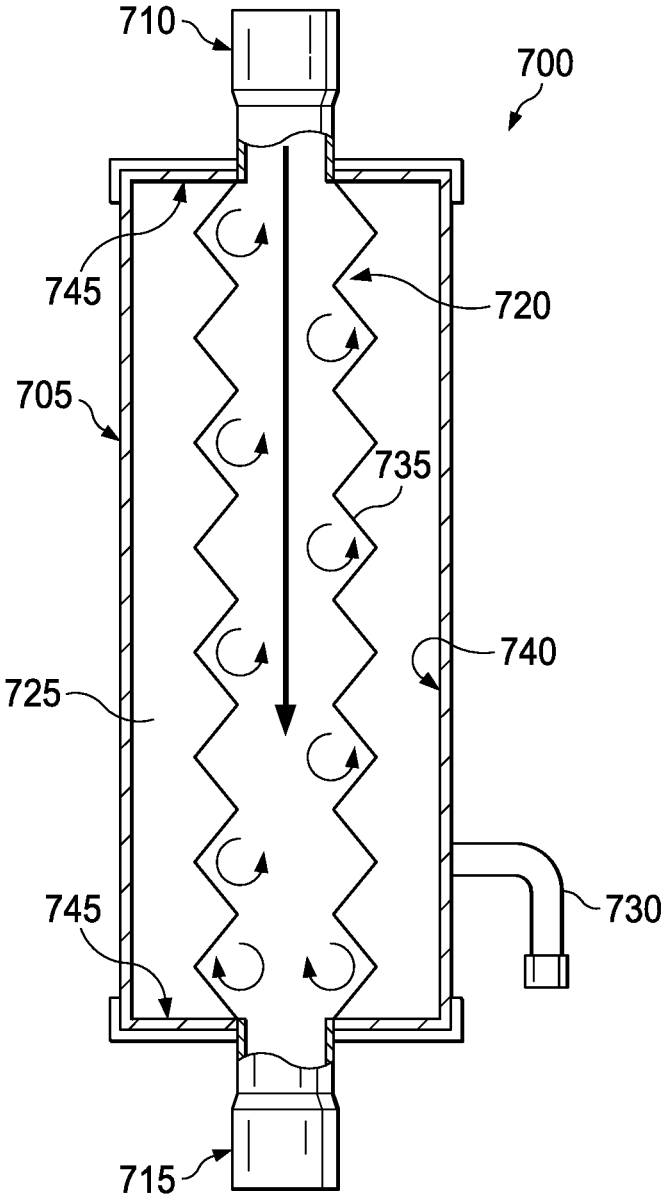
FIG. 7 illustrates a sectional view of another embodiment of the compensator as provided herein.

FIG. 7 illustrates a sectional view of another embodiment of the compensator 160. In this embodiment, the compensator 700 comprises a housing 705, which is appropriately constructed of a material, such as metal, that can withstand the operating pressures of a heat pump system. The housing 705 is hollow and as an internal volume and further includes first and second ports 710, 715 for allowing a passage of refrigerant through the housing 705. The first and second ports 710, 715 may either be exit ports or entry ports, depending on the operational mode of the heat pump system to which the compensator 700 is connected. The ports 710, 715 may also have different configurations, depending on the embodiment. For example, in the illustrated embodiment, the ports 710, 715 are separate connection nipples that are welded to an opening in the housing 705, as shown in FIG. 7.

In the embodiment of FIG. 7, the internal volume is partitioned into an indirect refrigerant passageway 720 that extends through the housing 705, and a refrigerant storage area 725 that is in contact with the indirect refrigerant passageway 720, as illustrated. Additionally, the refrigerant storage area 725 has a storage access port 730, which allows the compensator 700 to be connected to the refrigerant line 135 in a manner discussed above regarding FIG. 1.

In this particular embodiment, the partitioning is accomplished by providing an irregular shaped wall 735 that may have a serpentine configuration, such as a spiral configuration or the corrugated configuration that is shown. The wall 735 is attached to interior surfaces 745 of the housing 705. The wall 735 forms the storage area 725 between the perimeter of the wall 735 and the interior surface 740 of the housing 705. Typically, the ends of the wall 735 will be welded to the interior surfaces 745 to form a seal between them. This particular embodiment presents another example of an indirect refrigerant passageway in that it includes a serpentine surface along the refrigerant path that increase the heat transfer surface of the compensator 700.

The above disclosure illustrates examples of embodiments of the compensator as generally provided herein, and one that has a significant larger amount of heat transfer surface area, which improves the efficiency of the heat pump unit in which it may be employed. Further, these designs can easily be scaled for larger or smaller unit sizes.

Those skilled in the art to which this application relates will appreciate that other and further additions, deletions, substitutions and modifications may be made to the described embodiments.

What is claimed is:

1. A refrigerant charge compensator, comprising:

a housing having an internal volume and first and second ports for allowing a passage of refrigerant therethrough, said internal volume being partitioned into an indirect refrigerant passageway that extends through said housing and first and second refrigerant storage areas being spaced apart, a storage access port connected to each of said first and second refrigerant storage areas and said first and second refrigerant storage areas contacting said indirect refrigerant passageway, wherein said indirect refrigerant passageway comprises;

a volume separated from said first and second refrigerant storage areas and defined by a first wall attached to an interior surface of said housing and having an opening therethrough and a second wall attached to an interior surface of said housing and having an opening therethrough and spaced apart from said first wall, said volume being fluidly connected to a first refrigerant tube attached to said opening of said first wall and that extends outside of said housing through said first refrigerant storage area to provide said first port and a second refrigerant tube attached to said opening of said second wall and that extends outside of said housing through said second refrigerant storage area to provide said second port.

2. A refrigerant charge compensator comprising:

a housing having an internal volume and first and second ports for allowing a passage of refrigerant therethrough, said internal volume comprising an indirect refrigerant passage way and a refrigerant storage area; and a storage access port connected to said storage area, said storage area contacting said indirect refrigerant passageway, said indirect refrigerant passageway comprising;

a first indirect refrigerant passageway having a first wall attached to an interior surface of said housing and having an opening therethrough and second indirect refrigerant passageway having a second wall attached to an interior surface of said housing and having an opening therethrough and spaced apart from said first wall, said first indirect refrigerant passageway being fluidly connected to a first refrigerant tube that extends from said first indirect refrigerant passageway and outside of said housing to provide said first port and a second refrigerant tube that extends from said second indirect refrigerant passageway and outside of said housing to provide said second port, said first and second refrigerant passageways fluidly coupled by a tube that extends from said first wall, through said storage area, to said second wall.

3. A heat pump system, comprising:

a compressor, an inside heat exchanger in fluid connection with said compressor by a first refrigerant line;

an outside heat exchanger in fluid connection with said compressor by a second refrigerant line;

a compensator in fluid connection with said first refrigerant line and located between said inside heat exchanger and said compressor, said compensator, comprising, a housing having an internal volume and first and second ports for allowing a passage of refrigerant therethrough, said internal volume being partitioned into an indirect refrigerant passageway that extends through said housing, and first and second spaced apart refrigerant storage areas, a storage access port connected to each of said first and second spaced apart storage areas and said first and second spaced apart refrigerant storage areas contacting said indirect refrigerant passageway, wherein said indirect refrigerant passageway comprises;

a volume separated from said first and second refrigerant storage areas and defined by a first wall attached to an interior surface of said housing and having an opening therethrough and a second wall attached to an interior surface of said housing and having an opening therethrough and spaced apart from said first wall, said volume being fluidly connected to a first refrigerant tube attached to said opening of said first wall and that extends outside of said housing through said first refrigerant storage area to provide said first port and a second refrigerant tube attached to said opening of said second wall and that extends outside of said housing through said second refrigerant storage area to provide said second port; and a third refrigerant flow line fluidly connecting said inside heat exchanger and said outside heat exchanger and having first and second bypass valves and thermal expansion valves connected thereto and located between said inside heat exchanger and said outside heat exchanger, said refrigerant storage area in fluid connection with said third refrigerant flow line through said storage access port.

4. A heat pump system, comprising:

a compressor, an inside heat exchanger in fluid connection with said compressor by a first refrigerant line;

an outside heat exchanger in fluid connection with said compressor by a second refrigerant line;

a compensator in fluid connection with said first refrigerant line and located between said inside heat exchanger and said compressor, said compensator, comprising, a housing having an internal volume and first and second ports for allowing a passage of refrigerant therethrough, said internal volume comprising an indirect refrigerant passage way and a refrigerant storage area; and a storage access port connected to said storage area, said storage area contacting said indirect refrigerant passageway, said indirect refrigerant passageway comprising;

a first indirect refrigerant passageway having a first wall attached to an interior surface of said housing and having an opening therethrough and second indirect refrigerant passageway having a second wall attached to an interior surface of said housing and having an opening therethrough and spaced apart from said first wall, said first indirect refrigerant passageway being fluidly connected to a first refrigerant tube that extends from said first indirect refrigerant passageway and outside of said housing to provide said first port and a second refrigerant tube that extends from said second indirect refrigerant passageway and outside of said housing to provide said second port, said first and second refrigerant passageways fluidly coupled by a tube that extends from said first wall, through said storage area, to said second wall.

5. A refrigerant charge compensator, comprising:

a housing having an internal volume and first and second ports for allowing a passage of refrigerant therethrough, said internal volume being partitioned into an indirect refrigerant passageway that extends through said housing and a refrigerant storage area, said indirect refrigerant passageway defined by a wall attached to an interior surface of said housing, said indirect refrigerant passageway fluidly connected to a first tube that extends outside of said housing from said indirect refrigerant passageway to provide said first port and a second tube attached to said wall that extends through said storage area and extends outside of said housing to provide said second port; and a storage access port connected to said refrigerant storage area.

* * * * *